United States Patent [19]

Shriver et al.

[11] Patent Number: 4,749,122

[45] Date of Patent: Jun. 7, 1988

[54] COMBUSTION CONTROL SYSTEM

[75] Inventors: James E. Shriver, Mansfield, Mass.; David P. Dickhaut, Wilmington, N.C.

[73] Assignee: The Foxboro Company, Foxboro, Mass.

[21] Appl. No.: 864,693

[22] Filed: May 19, 1986

[51] Int. Cl.[4] ..... F23N 1/08

[52] U.S. Cl. ..... 236/14; 122/448 R; 236/15 BD

[58] Field of Search ..... 122/448 R, 448 A; 431/2, 12; 236/14, 15 E, 15 BD

[56] References Cited

U.S. PATENT DOCUMENTS

| | | | |
|---|---|---|---|
| 3,877,636 | 4/1975 | Sato | 236/14 |
| 4,045,292 | 8/1977 | Matsushita et al. | 236/15 E X |
| 4,054,408 | 10/1977 | Sheffield et al. | 431/12 |
| 4,238,185 | 12/1980 | Watson | 431/76 |
| 4,309,949 | 1/1982 | Rastogi | 110/341 |
| 4,330,261 | 5/1982 | Sun | 236/15 E X |
| 4,421,473 | 12/1983 | Londerville | 431/76 |
| 4,439,138 | 3/1984 | Craig et al. | 431/12 |
| 4,449,918 | 5/1984 | Spahr | 431/74 |
| 4,474,121 | 10/1984 | Lewis | 110/346 |
| 4,576,570 | 3/1986 | Adams et al. | 431/12 |
| 4,676,734 | 6/1987 | Foley | 431/12 |

FOREIGN PATENT DOCUMENTS

| | | |
|---|---|---|
| 943966 | 11/1955 | Fed. Rep. of Germany . |
| 1343944 | 10/1963 | France . |

OTHER PUBLICATIONS

*Maximizing Combustion Efficiency with "Expert Based Systems"*, James E. Shriver; May 1985.

*Peak Seeking Optimizers*, "Instruments and Control Systems"; Oct. 1962.

*Potential Applications of Peak-Seeking Optimizers*, C. L. Mamzic, 1961.

*Process Instrumentation*, 1969, John Wiley & Sons Inc., D. P. Eckman; "Automatic Process Control".

*ISA Transactions*, vol. 17, No. 3, 1978, F. D. Gelineau; "Coal Firing Control and Operational Considerations".

*Journal A*, vol. 25, No. 3, Jul. 1984, M. de Hagen et al.: "Boiler Combustion Optimization by Controlling Air/Fuel Ratio".

*Power*, Sep. 1984, Jason Makansi et al.: "Monitoring Powerplant Performance".

*Primary Examiner*—Edward G. Favors

*Attorney, Agent, or Firm*—Terrence (Terry) Martin; Jack H. Wu

[57] ABSTRACT

In a combustion system, the economic optimum efficiency is achieved by periodically computing a relative index of combustion efficiency using the combustion chamber as a real-time, on-line calorimeter. This is accomplished by first determining the combustion chamber inputs and outputs required to calculate a relative index of performance (including measuring the amount of heat released or work performed at the present air/fuel ratio including the stack losses, without oxygen and/or carbon monoxide sensors), sequentially comparing the latest relative index value with the previous value, then adjusting the air/fuel ratio to achieve an improved index value.

30 Claims, 9 Drawing Sheets

COMBUSTION CONTROL SYSTEM

TECHNICAL FIELD

The present invention relates to a method and apparatus for optimizing the efficiency of a combustion device by developing a relative index of efficiency to direct an automatic control system without flue gas analyzers. More particularly, the present invention is directed to improved combustion control systems including an optimization function which continuously seeks an optimal operating point of the air/fuel ratio and makes adjustment to the control settings to maximize the relative index of efficiency using the combustion system itself as a calorimeter. It is particularly applicable where the quality of the air/fuel supplied to the combustion system varies, and where flue gas analyzers cannot be used or justified for cost reasons. In an alternate embodiment, the optimization function repeatedly seeks the most economical operating point, rather than the maximum energy output operating point.

BACKGROUND ART

All combustion control systems include at least an air flow (oxygen) subsystem and a fuel flow subsystem. Many types of control schemes are commonly used by those skilled in the art to control the air/fuel ratio; they are generally characterized as either positional or metering type systems.

Positioning systems are often used in smaller combustion systems and solid fuel units, where one or both flows are not usually measured. The combustion device energy supply controller, whether pressure, flow, and/or temperature based, positions either a single shaft (i.e., commonly called a jack shaft), a fuel flow element, or an air flow element which in turn causes a change in the air and/or fuel flow into the combustion device. The air/fuel ratio is substantially fixed, determined by the mechanical linkage. These systems generally cannot maintain a precise air/fuel ratio when either the air or the fuel characteristics change from the initial ratio calibration. Such systems are generally biased to operate in the inefficient range with very substantial ecess air throughout the load range and normally do not or cannot adjust for daily changes in input air and/or fuel characteristics such as relative humidity, temperature, combustion air supply fan parameters, linkage wear, changes in fuel characteristics, and other problems. There is no correction for unburned carbon losses or loss of combustion volatiles. The combustion control system is adjusted for the expected worst case condition plus an amount of excess air believed to be sufficient to avoid series problems. Such a prior art system is shown in FIG. 2 of the appended drawings.

Metered systems are useful where the air/fuel flows can both be measured. Typically, cross limit controls can be installed in a lead-lag combination such that fuel flow lags air flow when increasing the combustion firing rate, and fuel flow leads air flow when decreasing the combustion firing rate. Such a prior art system is shown in FIG. 3 of the appended drawings.

Optimization of the fuel/air ratio usually involves the use of flue gas analyzers in the exhaust passageway. Various schemes have been employed, some trimming the fuel flow and others trimming the combustion air (oxygen) flow, based on the percent oxygen signal derived from an exhaust gas sensor. The assumption is made with oxygen (and carbon monoxide) analyzer-based controllers that the measurement can be related to the amount of excess combustion air mixing with the fuel in the combustion zone. A control set point indicative of the desired excess air is entered as a controller input. Many problems are associated with such systems. The oxygen (or air) present in the stack may have leaked into the analyzer path upstream of the combustion zone. Many combustion devices, i.e., negative draft and induced draft devices, operate at an absolute pressure which is less than atmospheric. Reducing actual combustion zone air to lower the inferred 'excess air' measurement to the set point may result in an actual air deficiency in the combustion zone. This results in the combustion device actually operating at an inefficient level even though the control system indicates optimized operation. From a review of FIG. 4 it can be noted that efficiency drops off more rapidly on the insufficient air side of the efficiency peak than on the excess side. The slope of the efficiency loss from the peak can be 10 to 15 times greater for insufficient air than for the excess air case.

Flue gasses are subject to stratification, thus the gas analyzer must be carefully positioned. An analyzer which is not properly located results in erroneous readings which lead to inefficient operation.

Common oxygen analyzers provide either a percent dry output or a percent wet output. Percent dry analyzers are usually of the sampling type, with the amount of water vapor being condensed. They result in long response times to varying conditions and require high maintenance of the associated analyzer system components (pumps, water cooling, etc.) More modern analyzers are of the zirconium oxide 'in situ' type operating according to the well-known Beer's Law. In these units, the probe temperature is above the ignition temperature of the combustibles in the flue gasses. Incomplete reaction products use up available oxygen at the sample point, giving a percent output value which is lower than the actual value, again leading to inefficient operation.

The percent oxygen (or combustion air) set point initially determined as optimum is often not a constant as certain conditions change over time. Such variations include fuel characteristic changes which require more or less air; mechanical efficiency of the burning mechanism can vary, requiring more or less oxygen to avoid forming carbon monoxide or smoke. Since the oxygen controller is always a one-way (increase/decrease) action device (that is, for an increase in measured percent oxygen the controller reduces air to maintain its set point at zero), this action is incorrect on many solid fuels as the combustion chamber is also in fact a fuel drier. When high moisture content fuel is encountered the combustion process slows down and the excess oxygen detected by the stack gas analyzer increases; the subsequent reduction of combustion air by the oxygen controller exacerbates the actual problem and the fuel bed may be extinguished.

Another problem associated with flue gas oxygen analyzers is frequent periodic maintenance and/or accuracy drift. Duplicate equipment for redundancy is expensive. Since the entire control scheme is dependent on the reliability and accuracy of the gas analyzer, and since the analyzer is subjected to a harsh operating environment, failures and out-of-specification drift will cause inefficiencies and system failures. A failure or inaccuracy in the high signal direction (i.e., indicating excess air) can result in an unsafe condition being created as the oxygen controller will decrease combustion air supply. A failure or inaccuracy in the low signal direction can result in high excess air as the controller reacts to the low signal; at low loads this may actually 'blow out' the flame by creating a lean fuel mixture.

Other problems encountered with flue gas analyzer systems include high initial installation and continuing maintenance expenses which often cannot be justified. Specifically, fuel savings in smaller combustion devices, or applications where the fuel costs are low, may not offset the costs of an expensive oxygen and/or carbon monoxide analyzer system. Also, many combustion devices (such as metal heating furnaces) operate at temperatures above the upper temperature limit of a conventional oxygen probe and therefore such furnaces lack satisfactory optimization solutions. Many combustion devices do not have room in their combustion zones to install a conventional oxygen and/or carbon monoxide probe properly, and the problem is particularly exacerbating when multiple zone furnaces share a common flue gas outlet, where each combustion chamber must be individually monitored.

Sometimes a carbon monoxide gas analyzer is also installed to overcome some of the foregoing problems. Such an analyzer permits an inference of 'peak efficiency' because in theory carbon monoxide is found only as a product of insufficient air in the combustion zone. Unintended air infiltration will only cause a slight dilution in the carbon monoxide measurement.

Current carbon monoxide analyzers require cooling of the necessary electronics to prevent overheating; this requires either air purge blowers or cooling water supplies, which incur failures resulting in analyzer failures. As with the oxygen analyzers, carbon monoxide analyzers require frequent maintenance by highly trained personnel, they are associated with high initial costs, suffer high failure rates, and have relative low maximum temperature limits (e.g., 600 degrees Fahrenheit).

In addition to the multiplied expense of such combination oxygen/carbon monoxide analyzer systems, the carbon monoxide analyzers are subject to 'zero point' calibration drift. Conventionally, to recalibrate the analyzer, the excess combustion air is increased, then minimal carbon monoxide inferred in the measurement and the measured value taken as the zero point. However, plugged or cracked burners generate carbon monoxide even at high excess oxygen levels. Thus the inferred zero calibration procedure masks inefficiency and other problems.

In certain applications, and with certain fuels, other serious limitations of oxygen and oxygen/carbon monoxide analyzer systems exist such that they are inefficient or completely inappropriate. For example, on solid or liquid fuels, unburned hydrocarbons are formed prior to carbon monoxide, representing fuel losses which are undetected by the sensors. In superheated steam-producing combustion apparatus, the most economical operating point may not occur at maximum combustion efficiency, since it may be more economical to operate at excess air levels and gain additional superheat temperature.

With solid fuels it is possible to have carbon monoxide form at high excess air levels by physically blowing partially combusted particulate matter off the fuel bed, causing a release of carbon monoxide. Subsequently, the prior art control system will adjust the air/fuel ratio in the wrong direction because it necessarily assumes that carbon monoxide is a product of insufficient air. Unburned carbon losses due to flue gas particulates and unburned flue gas volatiles are not ordinarily considered in determining combustion efficiency. A serious control problem exists in solid fuel grate fired combustion devices, even when equipped with both oxygen and carbon monoxide analyzers. Significant quantities of fuel can be left on the grate and lost into the ash pit even when the oxygen and carbon monoxide systems are properly operating as intended. This loss can be significant and can usually be recovered by adding more combustion air than the sensors indicate is needed. These losses have not generally been considered when determining combustion efficiency. Also, the fuel bed can channel (develop holes) and permit combustion air to pass unreacted through to the analyzers where it is detected and treated as excess air. Here, the efficiency appears higher than it actually is, and unless periodic ash samples are checked for remaining combustibles, the inefficiency will go unnoticed.

U.S. Pat. No. 4,033,712 to Morton attempts to overcome similar limitations by a simple system in which only the exhaust gas temperature (EGT), i.e., the wasted heat, is measured. The Morton patent is directed solely to seeking the air/fuel ratio which produces the maximum combustion produced temperature, as measured by an exhaust temperature sensor which allegedly mesures the EGT. This will not work on an industrial furnace because the exhaust stack gas temperature thereof goes down when excess air is reduced (higher efficiency, see FIG. 4), not as in the Morton patent where the exhaust temperature of the engine goes up. There is no consideration in the Morton patent of the net heat (as opposed to EGT) released in the combustion process, i.e., heat absorbed in the work product, preheaters, auxiliary heaters, heat recovery units, etc. Nor is there any attempt to estimate or calculate the net heat released by the combustion process as an indication of efficiency. In the sole specific use disclosed in the Morton patent, a stationary internal combustion engine's exhaust temperature is maximized.

Also known in the prior art are U.S. Pat. Nos. 3,184,686 to Stanton, and 4,054,408 to Sheffield et al. The controller of the '686 patent closely follows a paper entitled "Optimalizing System for Process Control presented at the 1951 meeting of the Instrument Society of America by Y. T. Li, summarizing the Massachusetts Institute of Technology work of Dr. C. S. Draper. Other related patents include U.S. Pat. Nos. 4,253,404 and 4,235,171 to Leonard; U.S. Pat. No. 4,362,269 to Rastogi; and U.S. Pat. No. 4,362,499 to Nethery.

For the purposes of the present disclosure, the term "blowdown" is considered as the removal of liquids or solids from a process or storage vessel or a line by the use of pressure.

DISCLOSURE OF THE INVENTION

In a combustion system having a combustion chamber, controllable air and/or fuel inputs, and an exhaust outlet path, a relative index value of the absorbed net heat release of the combustion process is determined. This relative index of absorbed net heat release represents, generally the objective uses to which the heat of combustion are applied; it is used as a relative index of efficiency of the combustion process. It is then compared with a previous relative index value of the absorbed net heat release, and the air/fuel feed ratio is adjusted to optimize the combustion process. The combustion device is used as a real-time calorimeter to estimate the absorbed net heat release. In particular, the net heat inputs, the value detected by a temperature sensor in the exhaust and the net heat release (defined here as the sum of the absorbed heat and the stack heat losses) are regularly sensed and a relative index value related to efficiency derived therefrom is computed and stored. The relative index value may be periodically updated. For every change in combustion conditions, the resultant change in the relative index value is determined, compared with the previous relative index value and used to initiate changes in the air and/or fuel input feed to maintain peak combustion efficiency. Alternatively, the method and apparatus may also be used to optimize the efficiency of combustion apparatus in which most economical operation is achieved at other than peak combustion efficiency, such as steam production for co-generation of electricity using waste matter as fuel. A positive oxygen bias may be incorporated into the relative index of efficiency to avoid the "licking flame" syndrome and to assure safe operation which is not reducing and is also minimally oxidizing. The invention comprehends adding slight excess air bias when increasing the air/fuel ratio after previous reductions in the air/fuel ratio to ensure operation at the excess air side of the efficiency peak. Similarly, a slight reducing air bias may be added.

The present invention employs a combination of a specially designed regulatory control subsystem and an optimizing subsystem, and a method of using the apparatus. The invention finds application in pulp and paper mills, refuse resource reclamation plants, and sugar mills, as well as in reheat furnaces, soaking pits, melting furnaces, recovery boilers, lime kilns, enhanced oil recovery steam generators, and the equivalents.

BRIEF DESCRIPTION OF THE DRAWING FIGURES

Other features and advantages of the invention disclosed will be apparent upon examination of the drawing figures forming a part hereof and in which the present combustion control system invention is illustrated by way of examples:

Figure 1:
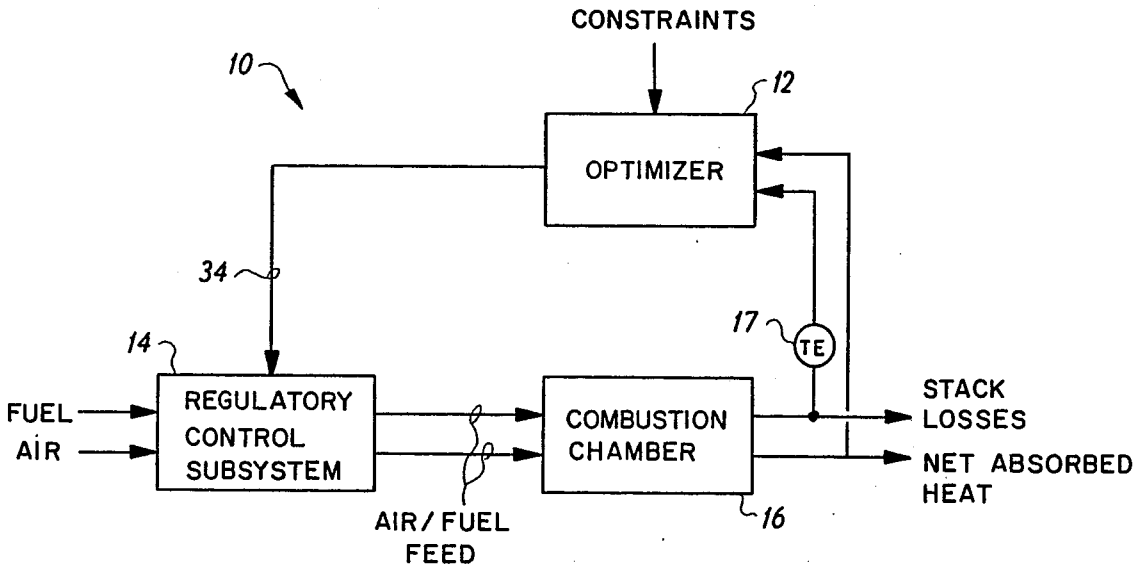
FIG. 1 is a simplified block diagram of the invention.

Like reference numerals describe like features; analogous elements performing substantially similar functions are identified by reference numerals which are increased by 100. For example, in FIGS. 2, 6, and 7 the combustion devices 16 are analogous to the combustion devices 116 of FIGS. 3, 8, and 9.

BEST MODE FOR CARRYING OUT THE INVENTION

Figure 6:
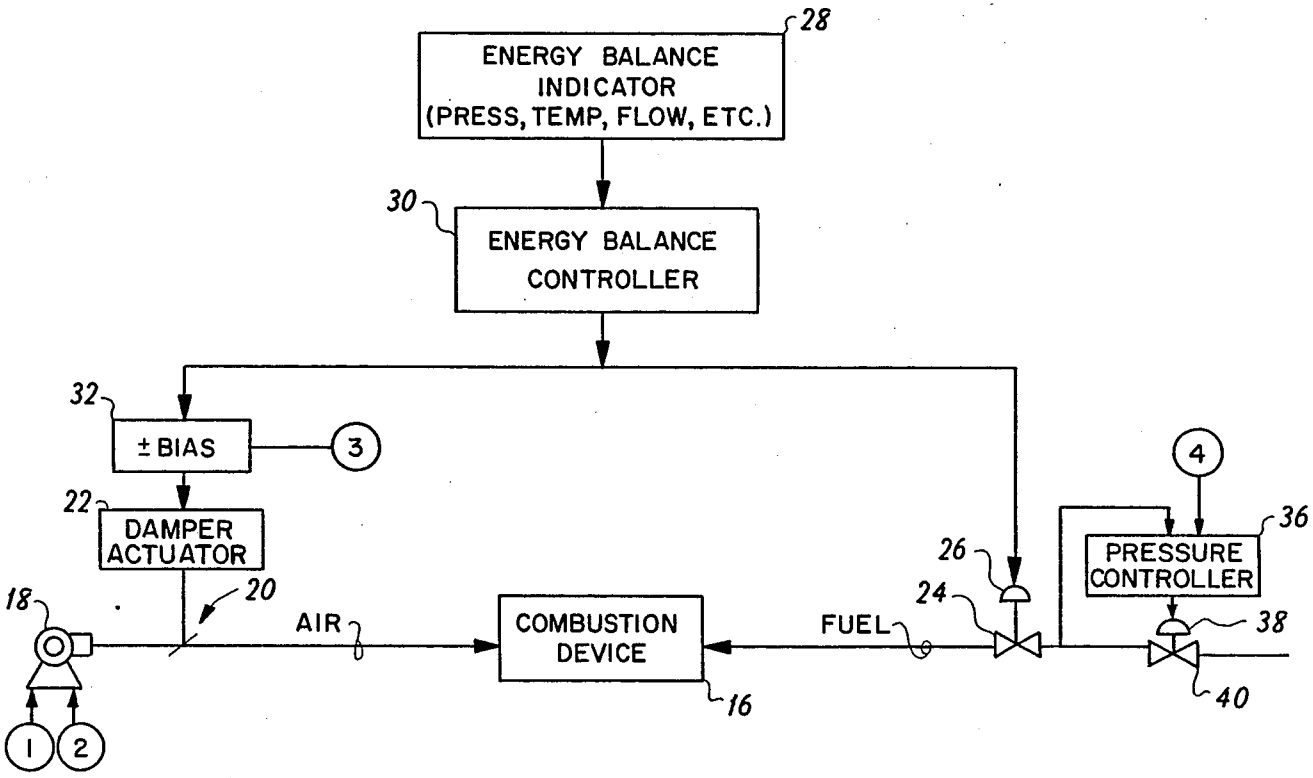
FIG. 6 is a simplified block diagram of the invention as applied in a simple positioning case.
Figure 7:
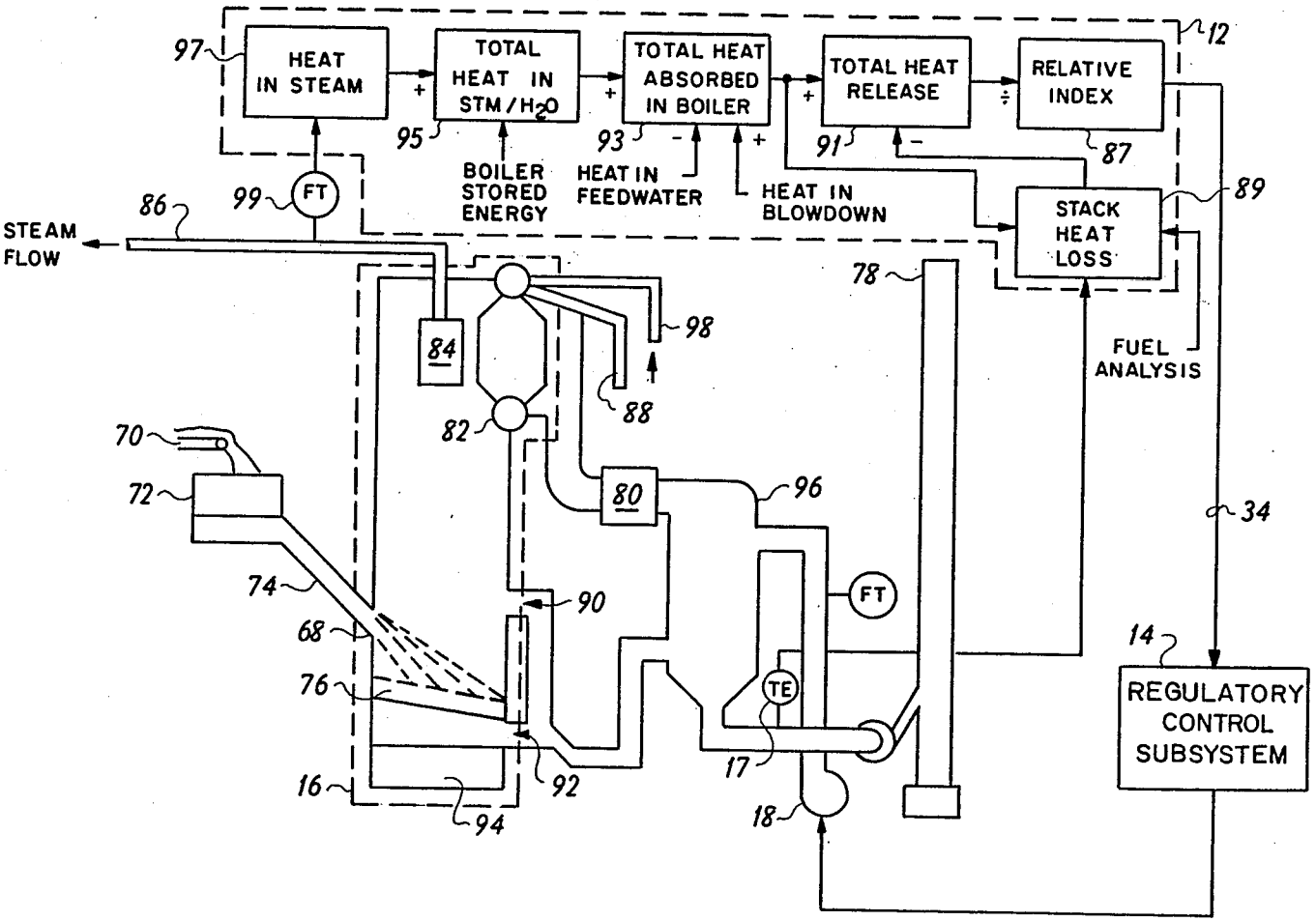
FIG. 7 is a more detailed diagram of the invention as applied to a specific simple case.
Figure 8:
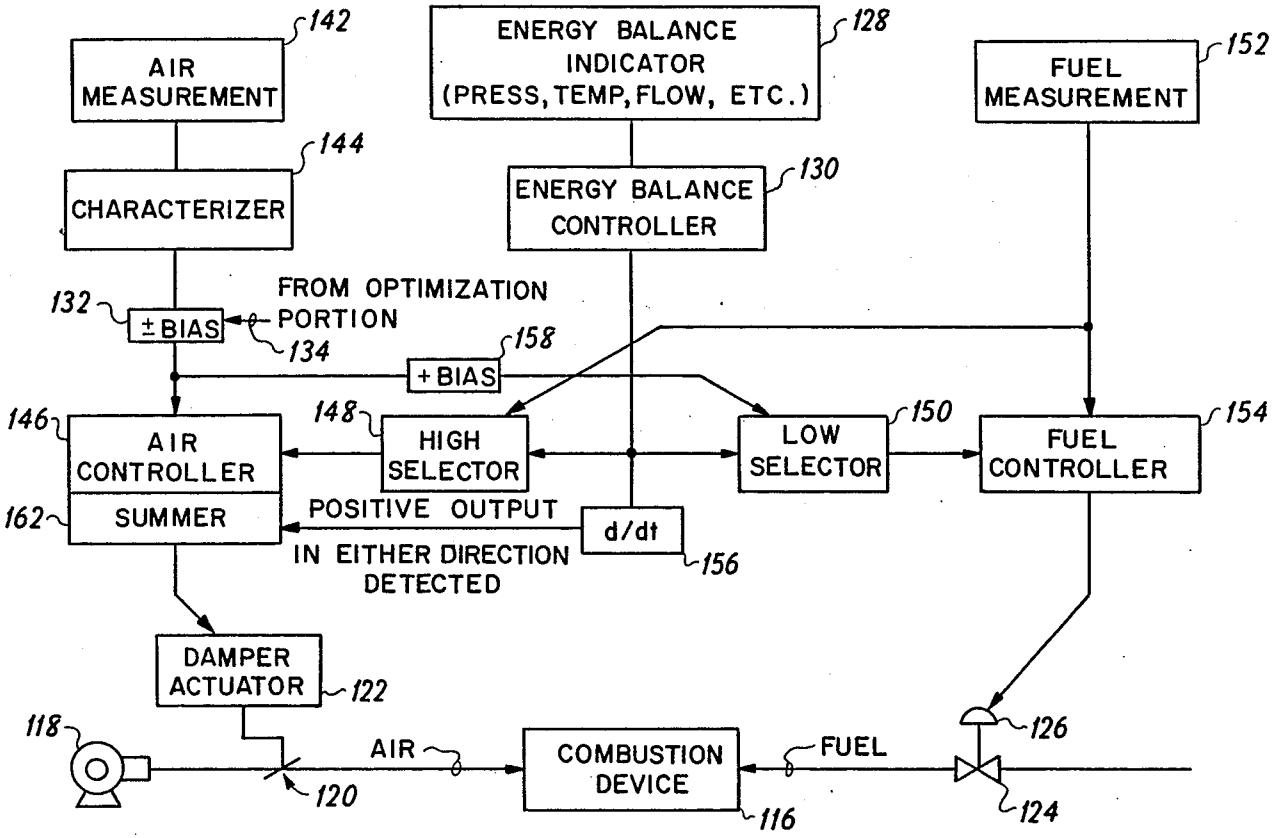
FIG. 8 is a simplified block diagram of the invention as applied to a metered system (i.e., a more complex) case.
Figure 9:
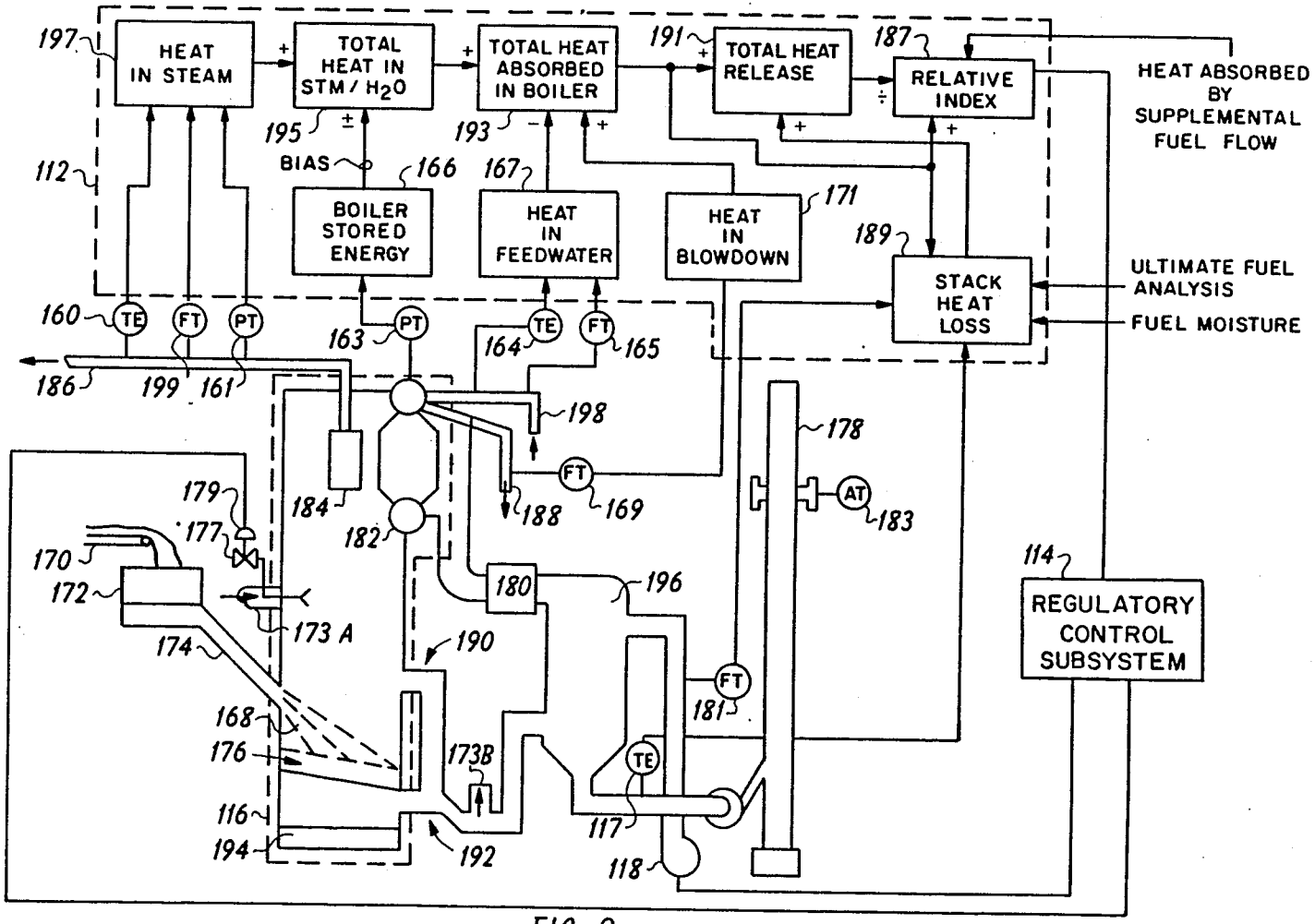
FIG. 9 is a more detailed diagram of the invention as applied in a specific, more complex case.

The apparatus of our present invention 10, see FIG. 1, includes means for both optimizing the combustion process and modification of the means for controlling the combustion process. There is shown in FIG. 1 combustion control system 10, optimizer 12, regulatory control subsystem 14, combustion chamber 16, and temperature sensor 17. For the purposes of clarity in the following description, the two major portions of the overall combustion system affected by the invention will be called the 'optimizer' 12 and the regulatory control subsystem 14. Further, two basic kinds of fuel-/air ratioing systems are described, the so-called positioning systems (FIGS. 2, 3, and 7) and metering systems (FIGS. 6, 8, and 9).

In operation, the combustion chamber 16 or device itself is used as a real-time calorimeter to produce a relative index of efficiency or of energy utilization. This relative index value, a partial function of the optimizalization means, permits the optimizer 12 to continuously seek an operating point where either an increase or decrease in the air/fuel ratio decreases the relative index of efficiency or of energy utilization. This relative index value of efficiency is calculated from real time measurements of the specific combustion device. The index may preferentially represent the energy (heat) absorbed as 'work'. See also FIG. 4.

Figure 2:
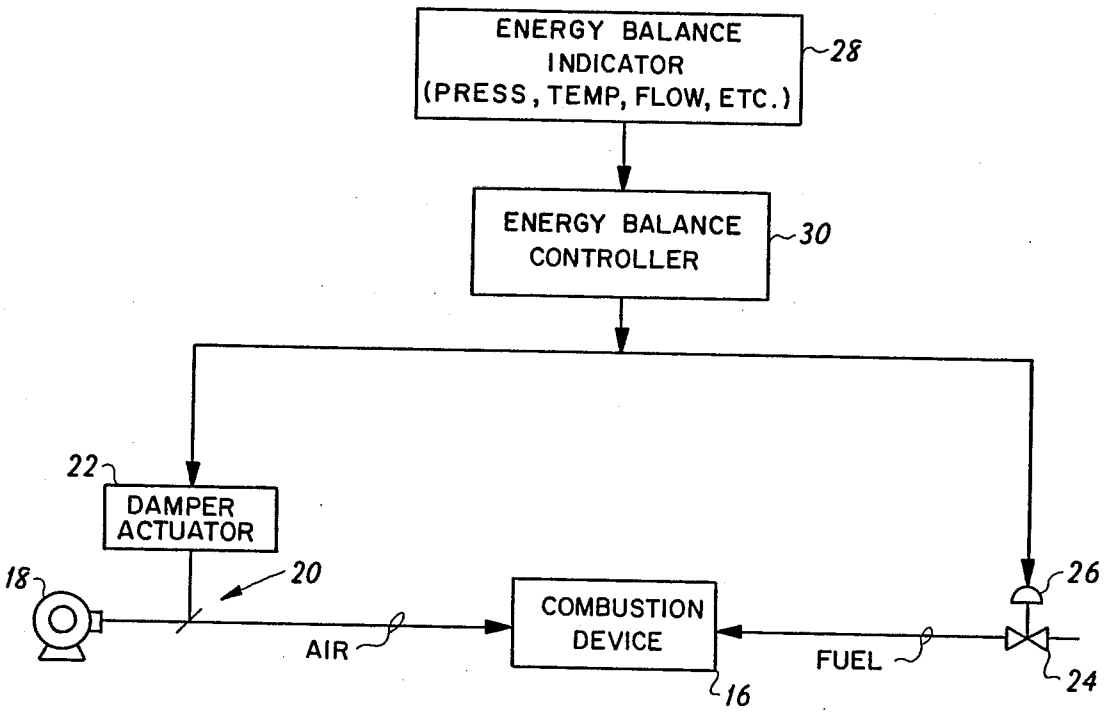
FIG. 2 (PRIOR ART)
FIG. 2 shows in simple block diagram form a common prior art positioning type air/fuel ratio control system.

There is shown in the prior art FIG. 2 combustion chamber 16, fan 18, damper 20, damper actuator 22, fuel valve 24, fuel valve actuator 16, energy balance indicator 28, and energy balance controller (or energy demand controller) 30. In the case of a simple positioning system, FIG. 2, the combustion chamber or device 16 is fed air via fan 18 and damper 20 and also fuel from an external source (not shown) via valve 24 influenced by actuator 26. An energy balance indicator 28 receives a signal related to the energy balance via a pressure, temperature, flow or otther suitable sensor which in turn directs the energy balance controller 30 to control the damper 20 via actuator 22.

The regulatory control subsystem operates continuously to regulate the input (flow, pressure, etc.) and heat output in view of the temperature and other requirements of the specific combustion process. In a typical positioning type system, means of modifying the the fuel/air ratio within prescribed, and predeterminable limits according to the optimizer are required. Several ways are available to modify the air/fuel ratio, including at least the following:

1. Vary the volume of combustion air supplied to the combustion chamber, such as by varying the speed of combustion air fan drives, if included; vary the position of an inlet air damper; or modify the position of an outlet damper on an induced draft fan.

2. Vary the fuel characteristics or volume. With solid fuel systems, it is often more convenient to vary the air.

The improvements required according to the present invention are shown in FIG. 6. There is shown in FIG. 6 combustion chamber 16, fan 18, damper 20, damper actuator 22, fuel valve 24, fuel valve actuator 26, energy balance indicator 28, energy balance controller (or energy demand controller) 30, bias block 32, pressure controller 36, actuator 38, valve 40, and representative inputs (1) (2) (3) (4) wherein (1) represents means (not shown) for varying the speed of the combustion air fan drives, (2) represents means (not shown) for varying the position of the inlet air damper on the combustion air fan, (3) represents means (not shown) for varying the position of the outlet air damper on the combustion air fan, and (4) represents means (not shown) for varying the fuel supply pressure. FIG. 6 shows the addition of an adjustable bias 32 and a pressure controller 36, actuator 38, and valve 40 according to the teaching of this invention, wherein the optimizer 12 (not shown) output signal controls the air/fuel ratio by control of the fan 18 speed (1) or inlet air (2) via inlet vane damper (not shown), by control of the air side linkage (3), or by control of the fuel supply (4) which may be by means of a pressure control (36, 38, 40) apparatus for fluid fuel or alternatively by means of a conveyor and spreader apparatus (see FIG. 7) for solid fuels, or those equivalents known to those skilled in the art. The control may be exercised via conventional controller devices which are well-known to those of ordinary skill in the art.

Figure 3:
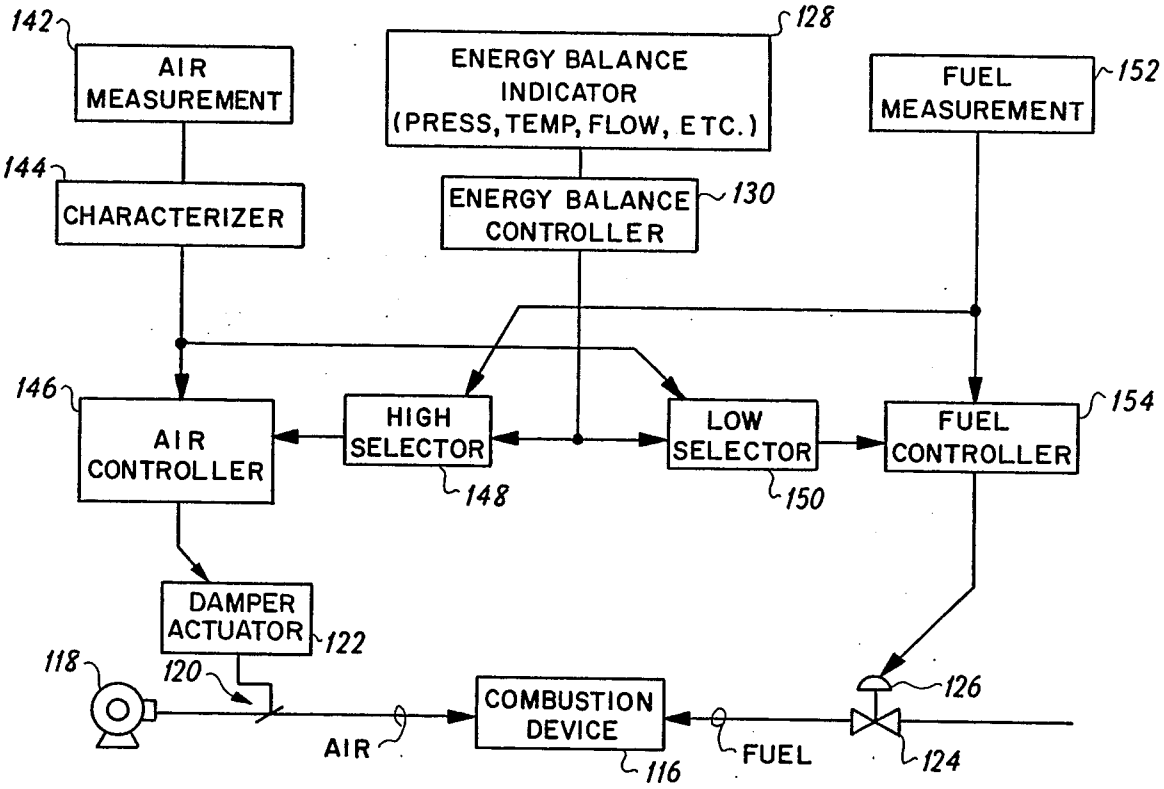
FIG. 3 (PRIOR ART)
FIG. 3 shows in simple block diagram form a common prior art metering tape air/fuel ratio control system.

Similarly, prior art FIG. 3 shows a metering type system which includes generally similar elements of the positioning type system, such as combustion chamber 116, fan 118, sampler 120, damper actuator 122, fuel valve 124, fuel valve actuator 126, energy balance indicator 128, energy balance controller (or energy demand controller) 130, air measurement means 142, air characterizer means 144, air controller 146, high selector 148, low selector 150, flow measurement means 152, and fuel controller 154. The metering type system is more complex than the ratioing system, and further includes additional measurement and control elements for both the air and the fuel inputs, or feeds. On the air side are air measurement means 142, "air characterizer" 144, and air controller 146. The air characterizer adjusts the measurement based on field tests. It is used because the air flow measurement is usually not obtained from a true square law type device such as an orifice plate, and therefore the measurement taken does not conform to the necessary square root law. The air flow signal on a metered system is a relative rather than an absolute value. It is indicative of the number of BTU's it will support. On the fuel side are the generally analogous fuel measurement means 152 and fuel controller 154. These elements provide ordinary measurement and conventional control of the air and fuel as is well known in the art. Also well-known are the cross-coupling control elements high signal selector 148 and low signal selector 150, which compensate appropriately for increasing and decreasing combustion chamber firing rates (a safety interlock to prevent a fuel-rich mixture from entering the combustion chamber 116).

Note that the fuel/air ratio modification choices will depend on available combustion equipment for retrofit situations, and on available equipment, configuration plans and design preferences, and budgetary constraints for new installations; therefore the invention as claimed is not limited to the particular equipment or equipment configurations disclosed herein.

For metering type systems, three modifications to the combustion air system shown in FIG. 8 permit the regulatory system to respond to air/fuel ratio change commands according to the present invention. There is shown in FIG. 8 combustion chamber 116, fan 118, damper 120, damper actuator 122, fuel valve 124, fuel valve actuator 126, energy balance indicator 128, energy balance controller (or energy demand controller) 130, bias block 132, optimizer output signal 134, air measurement means 142, air characterizer means 144, air controller 146, high selector 148, low selector 150, fuel measurement means 152, fuel controller 154, d/d, positive adjustable derivative action block 156, bias block 158 and summer function 162 (added to air controller 146).

These changes include adding an adjustable bias 132 to the air flow signal, adding a positive bias 158 to a low signal selector 150 (which selects the lower of the energy balance controller demand signal or the actual measured air signal), adding a summer function to the air controller 146 (if not otherwise available), and optionally adding a positive adjustable derivative action 156 input to summer 162 in the air controller 146 when the energy demand signal from the energy balance or demand controller 130 exceeds a given rate per unit of time (in either direction). Both the amount of derivative action and the rate per unit time should be adjustable.

These changes also permit satisfactory response to combustion control device commands while at very low excess air conditions.

Figure 4:
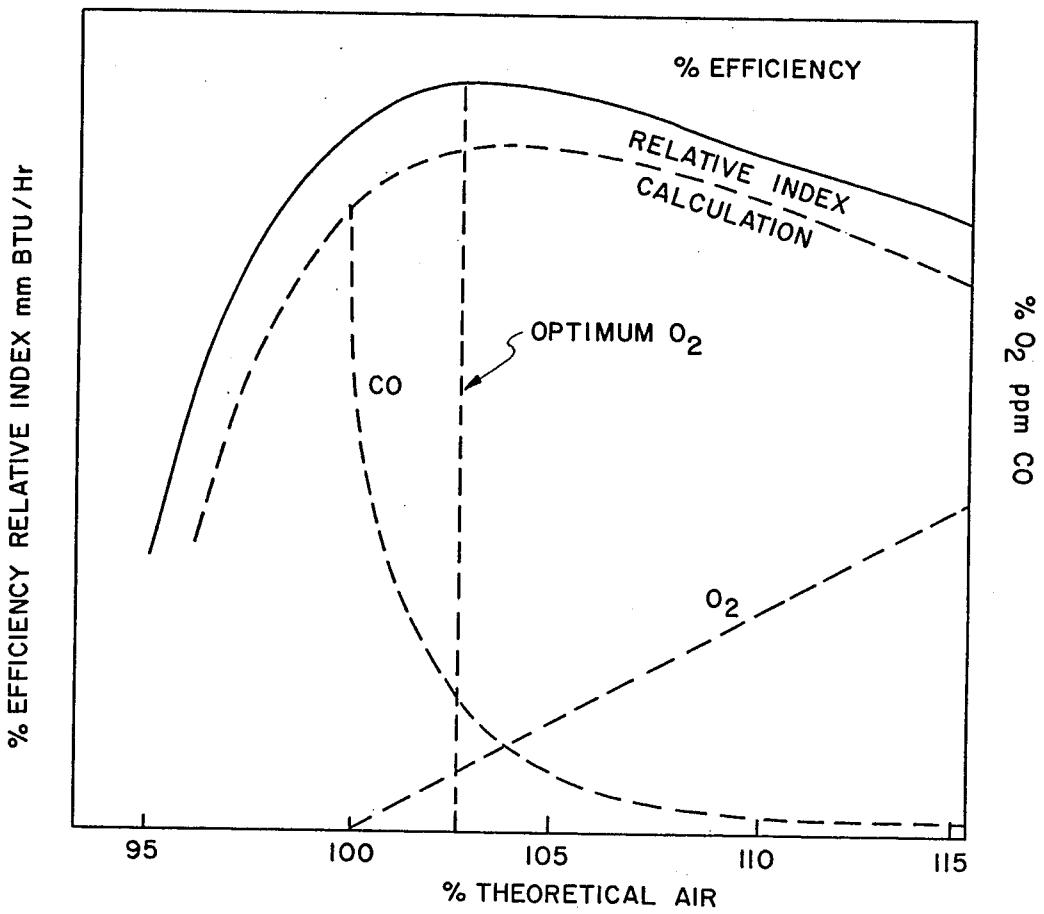
FIG. 4 is a graph showing the desired relative index of efficiency curve superposed on (and offset slightly from) a conventional percent air versus efficiency curve.

FIG. 4 illustrates a conventional plot, based on practical experience, of furnace efficiency as a function of the percentage of theoretical air. The carbon monoxide and oxygen combustion product outputs are also shown. Note that the vertical dashed line is conventionally understood to represent the amount of theoretical air capable of producing maximum heat release for a particular fuel. Note that the efficiency increases upward in the vertical direction. The efficiency curve rises as theoretical air approaches 100%, then falls on either side of a point representing just over 100% theoretical air. This peak, for practical purposes, represents maximum heat release efficiency. A similar efficiency peak occurs for the steam/fuel ratio, net heat release/fuel ratio, steam/combustion air ratio, and the net heat release/combustion air ratio. The optimizer of the present invention produces a relative index of efficiency (shown as a dashed line which is substantially parallel to the theoretical efficiency curve) which follows closely the theoretical efficiency curve. This curve is used to control the air/fuel ratio of the regulatory control subsystem of the invention for the embodiments disclosed here.

Figure 5:
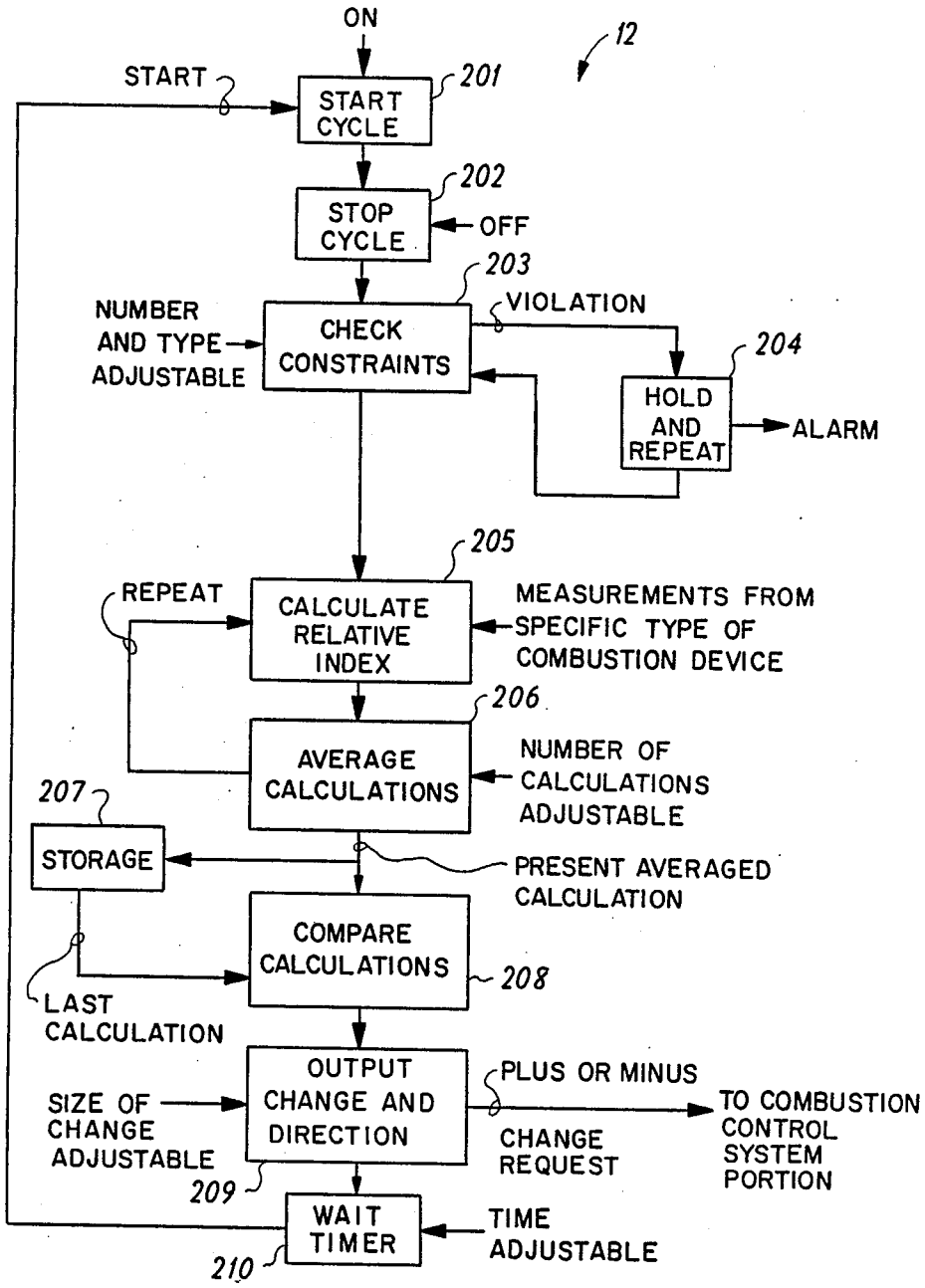
FIG. 5 illustrates the optimizer operation.

A generic description of the optimizer 12 operation is shown schematically in the diagram of FIG. 5. Hereinafter, words and phrases which are entirely capitalized identify functional blocks of the optimizer apparatus and underlined words and phrases identify signals and control lines. There is shown in FIG. 5 the optimizer 12, START CYCLE block 201, STOP CYCLE (interrupt) block 202, CHECK CONSTRAINTS block 203, HOLD AND REPEAT block 204, CALCULATE RELATIVE INDEX block 205, AVERAGE CALCULATIONS block 206, STORAGE block 207, COMPARE CALCULATIONS block 208, OUTPUT CHANGE AND DIRECTION block 209 and WAIT timer 210. The optimizer 12 operates in a periodic sample, output calculation, and hold sequence. The output calculation basically determines a net heat release to fuel demand ratio value; compares this value to a previous value, determines direction and quantity of heat output change, and bias if desired.

The START cycle 201 is activated by either initialization via the *on* or *off* lines or via *start* output signal from completion of a previous cycle. At the next step, STOP CYCLE 202, an interrupt function is included so that the cyclem can be manually stopped or turned off at this point. The system operating constraints are checked at CHECK CONSTRAINTS block 203. Note that these constraints are specific for each combustion device and are to be initially configured and subsequently may be adjusted during the process if needed, such as if conditions change from the original setup. This may be accomplished in a controller (preferably microprocessor based) by changing the controller modes and limit values, or in a computer (micro, mini, or mainframe) via the 'constraints' menu or equivalent. For example, this may be accomplished if implemented on a Spec 200 Micro TM controller (available from The Foxboro Company, Foxboro, Mass.) by changing over to the controller configuration mode and modifying the limit values. If implemented on Spectrum TM Multistation control systems (also available from The Foxboro Company), this is accomplished from the "constraints" menu. These examples are for descriptive purposes only, and are not intended to be limiting of the hereinafter appended claims. Equivalent apparatus and method steps may be substituted within the scope of the claimed invention.

These constraints typically may include limits on excessive demand changes such as would indicate a process upset or a transient condition in progress, a temperature limit violation, combustion device limitation, excessive smoke, improper controller mode setting (e.g., on manual), or such equivalent constraints in number and type as may be appropriate to the particular system configuration. The optimizer 12 switches to a hold and repeat mode at HOLD AND REPEAT blodk 204 and will remain in that mode if a constraint *violation* signal remains present. An *alarm* output signal may be provided to alert the operator to the HOLD AND REPEAT status. When CHECK CONSTRAINTS block 203 is free (e.g., constraints do not exist), the optimizer 12 advances to CALCULATE RELATIVE INDEX function block 205, where the specific relative index of efficiency or of energy utilization of the combustion device is calculated. The specific measurements must be configured for each combustion device. These measurements are discussed hereinafter.

At AVERAGE CALCULATIONS block 206, one or more calculations can be averaged. If a single calculation is to be used (not averaged), block 206 may be omitted. Note that at block 206, adjustment of the number of specific measurements to be averaged in calculating the relative index value is optional and may be adjustable if desired. This permits generation of a *present averaged calculation* output which is a representative average index value. An averaged calculation may be used to avoid incorrect results from noisy or improper signals. The present calculation output (averaged or otherwise) is coupled to both STORAGE block 207 (storage of last value) and to COMPARE CALCULATIONS block 208 (comparator), wherein a comparison is made between the averaged calculation of the previous cycle value stored in block 207 (i.e., the *last calculation* value) and the next *present (averaged) calculation*. The value representing the *present (averaged) calculation* is stored (block 207) and made available subsequently as the previous value for the next cycle. Only the present and immediate past cycle calculated values need be used.

At block 208 the two values are matched for the purpose of determining the relative algebraic magnitude and sign (plus or minus) of the difference and forwarded to block 209 where a signal related to the magnitude of the change is generated as the *plus or minus change request* signal, which is directed to the combustion control system. The amount of the output change may be adjustable; e.g., it may be scaled as desired. After the change has been made, a WAIT TIMER 210 is started. This time period may be adjustable and may depend upon the characteristics associated with the specific combustion device and use; it is the time required for the combustion device measurements to equalize at their new values after the output change has actually occurred. The cycle begins anew after the WAIT TIMER 210 cycles out and produces a *start* signal for block 201.

The specific inputs required for determination of the "relative index" will vary among combustion system configurations and are usually specific to each combustion device and configuration. For the purposes of illustration only, an examplary embodiment of the present invention is shown in FIG. 7 as applied to a combustion device making steam using biomass fuel. Analogous measurements are required for other combustion systems and combustion objectives; selection of such measurements is within the skill of the ordinary artisan in view of the present disclosure.

There is shown in FIG. 7 optimizer 12, regulatory control subsystem 14, combustion chamber 16, temperature sensor 17, fan 18, optimizer output signal 34, fuel spreader 68, fuel conveyer 70, fuel bin 72, fuel chute 74, grates 76, stack 78, cyclones 80, mud drum 82, superheater 84, steam out (pipe) 86, RELATIVE INDEX OUTPUT block 87, blowdown (pipe) 88, STACK HEAT LOSS block 89, overfire air 90, TOTAL HEAT RELEASE block 91, underfire air 92, TOTAL HEAT ABSORBED IN BOILER block 93, ash pit 94, HEAT IN STEAM/$H_2O$ 95, air heater (or preheater) 96, HEAT IN STEAM OUT block 97, boiler feed (pipe) 98, and flow sensor 99.

Typically, the steam production may be used for producing electrical power (e.g., co-generation), plant heating, other plant work loads, or any combination of these or equivalent uses. In the particular embodiment illustrated, the combustion device is "base loaded" i.e., it has a generally constant volumetric fuel feed rate without regard to fuel quality characteristic variations. The fuel quality may depend on hourly or daily weather conditions, rotation of supplied biomass fuel, etc. The type of combustion device shown in the example is commonly found in pulp and paper mills, refuse resource reclamation facilities, sugar mills, and other facilities which generate a waste solid fuel product such as biomass, refuse, trash, bagasse, coal, and other waste product solid fuels. Further, combinations of fuels can be used, including low cost or waste fuels in combination with commercially available (e.g., hydrocarbon) fuels. Such combinations may be ratioed to achieve maximum economy consistent with the combustion objective. Other combustion devices and/or the steam generator systems may also require careful control of the pressure of the steam leaving the boiler system. Note that the fuel characteristics in this base loaded configuration requires that substantially only the combustion air supply be varied to optimize the use of the energy supplied by the fuel. In other configurations, it may be more practical to vary the fuel characteristics or supply rate, and hold the air flow steady. A combination may be employed. Such systems include, without limitation: reheat furnaces, soaking pits, melting furnaces, recovery boilers, like kilns, and enhanced oil recovery steam generators.

For the simple case of FIG. 7 the fuel flow is constant and need not be considered in the calculations. However, for the complex case of FIG. 9, the fuel flow is changing and must be taken into account. A useful approximation of fuel flow can be derived by reverse calculations of the measurable outputs. The following procedure may be used. It does not relay on fuel measurement.

Divide the heat content of steam produced (in BTU/Hr.) by the lower heating value of the fuel (in BTU/lb.). Divide the result (in lb./Hr.) by the estimated percentage efficiency (decimal format). This estimated is usually between 60 percent and 85 percent for solid fuel boilers. This percentage may also be estimated by measuring stack temperature, making a percent oxygen test by Orsat analyzer or portable analyzer, knowing the composition of the fuel being burned at the time of measurement. Further estimation methods are available from the ASME. The result of this calculation is a good approximation of fuel flow in lb./Hr. Once this estimate of fuel flow is obtained, there are several methods of determining the estimated composition, weight, and heat content of the flue gases, known the analysis of the fuel.

The products of complete combustion for gaseous, liquid, and solid fuels can be readily determined by those of ordinary skill in the art. One reference work, the *North American Combustion Handbook*, at Part 3 thereof, entitled "Combustion Analysis", teaches the following useful formulas:

(1) weight of combustion products weight of fuel = (% C × 0.1248) + (% H × 0.352) + (% S × 0.053) − (% O × 0.0331) + the excess air effect
(2) Weight of $CO_2$/weight of fuel = % C × 0.0366
(3) Weight of $H_2O$/weight of fuel = % H × 0.0894) + (% moisture × 0.01)
(4) Weight of $SO_2$/weight of fuel = % S × 0.020
(5) Weight of $N_2$/weight of fuel = [(% C × 0.0882) + (% H × 0.02626) + (% S × 0.033) − (% O × 0.0333)] × [(1 + excess air %/100) + (% N × 0.01)]
(6) Weight of $O_2$/weight of fuel = [(% C × 0.0266) + (% H × 0.0794) + ((% S × 0.0979) − (% O × 0.01)] × (% excess air/100)

Where: C=carbon, H=hydrogen, S=sulfur, and O=oxygen, and the units are percentage of fuel on a weight basis.

With knowledge of the total weight of fuel, the weight of flue gas products, and the various percentages of each component, one of ordinary skill in the art can quantify the stack heat loss if the BTU/lb. per degree (Fahrenheit) heat content for each component is applied. These heat contents are well known, and may for example be found in the previously cited *North American Combustion Handbook*.

ASME specification PTC 4.1-1964, page 66, lists the instantaneous heat contents of dry flue gas products. For typical boiler flue gas temperatures, the heat content is 0.245 BTU/lb. per degree (Fahrenheit). This value can be used in lieu of the *North American Combustion Handbook* constants for the carbon dioxide, sulfur dioxide, nitrogen, and oxygen percentages of the flue gases. For the moisture portion, the ASME literature gives the heat content at 0.46 BTU/lb. per degree (Fahrenheit). This includes only sensible loss, however. The latent heat content value per pound, 1089 BTU/lb., must be added to the sensible heat loss.

In the example combustion device 16, the solid fuel is commonly injected into the combustion device 16 by a fuel conveyor 70 and fuel spreader 68 mechanism, shown in FIG. 7. Fuel combustion may occur (for example) in suspension or on one or more fixed or traveling grates 76. The total combustion air can be measured at a forced draft fan 18 intake by a piezometric ring, or on the discharge duct of a forced draft fan by a pitot tube, or such equivalent differential head producing devices as a venturi tube, air foil, pressure differential across an air preheater, or equivalent device, any of which are represented in this example as a sensor 18. In the present example, total combustion air is often split into overfire 90 and underfire 92 air streams. For this example, these two air flows will be assumed to be controlled by separate control apparatus (not shown) or based on a fixed proportion of undergrate/overfire air flow. The entering boiler feedwater via feed pipe 98 need not be measured for flow rate or temperature content; flow rate is assumed proportional to steam flow from steam out pipe 86 since drum level can be controlled at a constant level by a separate drum level controller (not shown, not part of the present invention) and the incoming temperature can be held essentially constant by a de-aerator pressure controller or other means not necessary to this invention (not shown). These heat values may be sensed and included in the relative index of efficiency calculation if necessary (see discussion of FIG. 9). Steam flow is measured at the boiler output by flow sensor 99 which can be a vortex meter, an orifice plate and differential pressure transmitters, or any of the equivalents known to those skilled in the art. Steam pressure and temperature are (but need not be) assumed to be constant in this example. Again, the more complex system of FIG. 9 includes these options.

Calculation of the relative index of efficiency begins at HEAT IN STEAM function block 97, where the measured steam flow (in pounds per hour in this embodiment) is assigned an assumed energy unit value in millions of BTU's per hour (MM BTU's/hr) by scaling the system flow measurement from flow sensor 99 by a constant BTU per pound value. This constant can be determined by one of ordinary skill in the art without undue experimentation, and may be readily derived from *Steam Tables*, a well known reference book by Keenan, Keyes, Hill, and Moore; John Whiley and Sons Inc., New York. The constant BTU per pound value is based on the fact that the pressure and temperature operating conditions present at steam out flow pipe 86 are substantially constant in this example.

The relative index determination is continued at HEAT IN STEAM/$H_2O$ function block 95 where the BTU per pound value derived in block 97 is simply conveyed to block 95. This may be done because, for the simple case, the *boiler stored energy* (the storage of heat in the steam generating system, i.e., water and steam) can be assumed to be a constant since the boiler drum pressure and water level are held constant. If this is not the case in a given application, appropriate sensors could be included to provide block 95 an appropriate value derived for this variable (see FIG. 9 example). The *heat in feedwater* (supply feedwater heat content) value in BTU per pound is subtracted at TOTAL HEAT ABSORBED IN BOILER block 93 from the HEAT IN STEAM/$H_2O$ value from block 95. This can be an unmeasured constant in the present embodiment, and assumes that the supply boiler feedwater is held at a constant temperature and that the flow rate can be assumed to be in a constant ratio to steam flow. An actual value for this input may also be sensed and input if needed (FIG. 9).

Also at block 93 (FIG. 7), an adjustment is made for blowdown heat losses, identified here as *heat in blowdown.* Because the incoming boiler feedwater conductivity is assumed to be a constant in this example, and because the boiler conductivity can be maintained effectively constant by a separate blowdown controller (not shown, not part of this invention), this value of blowdown heat is essentially a constant value. The inlet boiler feedwater has a heat content (enthalpy) associated with it. This value is the feedwater inlet temperature less 32 degrees F. Blowdown flow is a heat absorbed credit because it is absorbed heat. As is the incoming boiler feedwater, blowdown is treated here as the ratio of steam flow; it is heat removed that includes "heat absorbed" by the fuel. The stack loss, on the other hand, is a debit since it represents heat not absorbed from the fuel but passed out of the stack unutilized in heating the product(s). When incoming boiler feedwater conductivity is substantially constant and the boiler conductivity is controlled, the blowdown heat can be estimated based on a fixed percentage of steam flow.

For the present purposes, four major heat losses are considered when calculating stack heat losses at STACK HEAT LOSS block 89. They include:

i. Dry flue gas sensible heat losses including carbon dioxide and nitrogen;
ii. Latent and sensible heat losses due to fuel moisture and hydrogen content;
iii. Dry flue gas losses due to excess combustion air; and
iv. Heat losses due to incomplete combustion products (CO, $H_2$ etc.).

Of the foregoing, in the simple case, heat losses i and ii are dependent upon the fuel flow and analysis. It would, of course, be preferable that the mass flow rate of the fuel be accurately measurable, that the fuel analysis be known, and that the heat contents for the waste flue gas be determinable. This is difficult or impossible to economically achieve in cases using biomass fuel. Item iii need only be estimated for calculation purposes in this example. It is the object of the optimizer 12 in this simple case to balance items iii and iv for maximum energy utilization; or more specifically, to maximize available heat to total heat input ratio or the relative difference of available heat less stack losses.

The STACK HEAT LOSS at 89 is subtracted at TOTAL HEAT RELEASE functional block 91 from the absorbed heat value output from block 93 to give a relative value in million BTU's per hour.

The amount of stack heat loss is calculated at STACK HEAT LOSS block 89. The real-time measurement of flue gas temperature by sensor 17 is taken immediately after the last heat recovery device, such as air preheater 96, an economizer (not shown), etc. That is, the stack temperature is sensed after the last useful heat loss. For example, an air preheater 96 recovers much of the wasted heat leaving the furnace. It heats the incoming combustion air and reduces the amount of fuel used. Note that air must be heated from an ambient temperature up to the flame temperature for combustion. Then it begins to cool again as it goes through the radiation and convection heat transfer areas of the furnace. Finally, the waste gasses may go through an economizer (not shown) to recover more of the waste heat for use in the boiler feedwater or air preheater 96 which recovers heat into the supply air. Here, the point to be understood is that the stack heat loss is derived immediately after the last heat reclamation device and as close to it as possible. The higher heating value of the fuel (BTU/lb.), is also used in block 89 along with the fuel analysis. A person of ordinary skill in the art and familiar with the technology of combustion can estimate from published tables and charts the stack loss with acceptable accuracy without taking actual mass flow measurements of the exhaust gasses, excess air, and incomplete combustion products. Such tables and charts may be found in "Improving Boiler Efficiency", *Instrument Society of America Handbook;* "Energy Conservation Manual", Allied Corporation, Morristown, N.J.; and "Measuring and Improving the Efficiency of Boilers", Federal Energy Administration, Contract No. FEA-CO-04-50100-00 Report. By interpreting the stack heat losses and overall efficiency from the aforementioned charts and tables, the ordinary skilled artisan can fit the relative index curve to the desired inferred efficiency. (See FIG. 4) This portion of the procedure is performed off-line (not in real time) and is commonly referred to as "scaling" by those skilled in the art. For the simple case illustrated in FIG. 7 the fuel flow is held constant. If the fuel flow is variable, more complex calculations are required, as is described hereinafter for the example of FIG. 9.

It is important to note here that in the presently described example, the actual precision of the relative index of efficiency derived is not critical to successful optimizer operation; repeatability becomes a more significant factor as a relative performance evaluation (i.e., better or worse) can be repeatedly made by the optimizer.

Thus for the simple case being described, only two real-time measurements are of greatest significance in effectively estimating the combustion system efficiency. These are the steam flow and stack temperature. In the derivation of the relative index of efficiency in this simple example, if following a combustion air increase the relative index value increases, the optimizer attributes the increase to unburned carbon being present which was burned by the additional air. The optimizer then incrementally increases the air flow according to the described method of the invention until the relative index value stops increasing (an excess air condition is reached). A small bias may be added to ensure an optimum oxygen supply is maintained. Note in FIG. 4 that a slight increase in theoretical air results in substantially less efficiency loss than a slight decrease in theoretical air. In seeking the efficiency peak, the optimizer can be adjusted to provide larger or smaller incremental air changes above or below the detected peak efficiency.

The more complex example which is given in FIG. 9 for illustrative purposes draws on the suggested improvements to the simple case above. This example is applicable where multiple fuels are fired, and/or either the amount of solid fueld changes, the steam pressure and temperature, and/or the the blowdown rate changes over time. It is also applicable where most economical operation may be at a heat output rate which is less than maximized furnace efficiency. The optimizer 12 may require one or more signals related to these values in specific applications. The complex example given also illustrates the invention in the situation when an accurate air flow measurement is present (from sensor 181) in lb./hr. terms. In such case, excess air may be calculated. Also, gas opacity in stack 178 may impose a constraint input to the optimizer if the maximal efficiency determined by the relative index of efficiency is limited for environmental polution reasons. An opacity sensor 183 is shown in this example. Further, in situations when the fuel moisture content is the dominant component affecting heating value and fuel composition, as in biomass combustion, and when the moisture content changes frequently, a moisture signal (not shown) can be used to continuously modify the fuel analysis if a predictable relationship exists.

Where the solid fuel flow rate may vary based on varying steam requirements, as in the present example, it becomes necessary to calculate another relative index. In this example, total absorbed heat, less auxiliary fuel produced heat (solid fuel absorbed heat) which must be added to the stack heat losses and the sum divided into absorbed heat by the solid fuel. A ratio is thus provided which can be optimized as solid fuel flow changes. The ratio is the total absorbed heat by the solid fuel, to the total heat released by the solid fuel. This ratio, i.e.:

$$\frac{\text{absorbed heat by solid fuel}}{\text{absorbed heat by solid fuel + stack heat loss by solid fuel}} = \text{relative index}$$

This ratio allows for fuel and air changes between calculations of the relative index of absorbed net heat, based on the energy demand of the boiler master control. That is for example, a steam load increase in the process area of the plant will require changes to the amount of solid fuel if it is controlling steam pressure. Since the total absorbed heat appears in both the numerator and the denominator, the effect of a total fuel and air change between optimizer calculation cycles is neutralized. The ratio of the preferred absorbed net heat release to total heat release indicates the proper direction for changing the fuel/air ratio to obtain maximum efficiency.

There is shown in FIG. 9 optimizer 112, regulatory control system 114, combustion chamber 116, temperature sensor 117, fan 118, optimizer output signal 134, steam temperature sensor 160, steam pressure sensor 161, drum pressure sensor 163, boiler feedwater temperature sensor 164, boiler feedwater flow sensor 165, BOILER STORED ENERGY block 166, HEAT IN FEEDWATER block 167, fuel spreader 168, blowdown flow sensor 169, fuel conveyer 170, HEAT IN BLOWDOWN block 171, fuel bin 172, supplemental fuel combustion air supply input 173*a* and 173*b*, fuel chute 174, grates 176, supplemental fuel supply valve 177, stack 178, supplemental fuel supply valve actuator 179, cyclones 180, combustion air flow sensor 181, mud drum 182, opacity sensor 183, superheater 184, steam out (pipe) 186, relative index output block 187, blowdown (pipe) 188, STACK HEAT LOSS block 189, overfire air 190, TOTAL HEAT RELEASE (by all fuels) block 191, underfire air 192, TOTAL HEAT ABSORBED IN BOILER block 193, ash pit 194, TOTAL HEAT IN STEAM/$H_2O$ block 195, air heater (or preheater) 196, HEAT IN STEAM block 197, boiler feed (pipe) 198, and steam flow sensor 199. Note in FIG. 9 that the supplemental fuel combustion supply air input may be provided at two points, represented in this example at 173*a* and 173*b*, which are connected to a common supply (not shown).

In the more complex example of FIG. 9, steam temperature and steam pressure are not constant and are derived via sensors 160 and 161. These are needed to accurately compensate the steam flow signal from sensor 199 and also to derive the heat content of the steam flow. Drum pressure sensor 163 is required to detect stored energy changes affecting the steam heat content.

Boiler feedwater temperature sensor 164 and flow sensor 165 are needed if the supply temperature and percent blowdown are not constant. The supplemental fuel portion may also be needed, and when needed consists of combustion air supply 173, fuel supply valve and actuator 177, and fuel supply flow sensor 179. Additionally, the heat absorbed by the supplemental fuel flow is subtracted from the relative index in function block 187.

The amount of heat absorbed by the supplemental fuel flow is estimated from the total heat input multiplied by the efficiency (in decimal form) of the supplemental fuel flow. This efficiency can be determined by one skilled in the art as previously described for FIG. 7. The supplemental fuel flow need not be constant as long as means are provided to calculate the amount of heat absorbed by the supplemental fuel flow. Examples of sensors for such measurement and calculation include a vortex flow sensor or or orifice plate flow sensing apparatus and differential pressure transmitter for gaseous supplemental fuel flow, and knowledge of the fuel analysis, and/or a target flow sensor or positive displacement sensor for a liquid supplemental fuel flow, and knowledge of the fuel anaysis.

The complex case of FIG. 9 may also include installations where the solid fuel flow is variable. The optimizer must be able to distinguish between a rise in net heat release due to a fuel flow increase and a rise in net heat release due to a more efficient operation.

The invention disclosed also applies to other examples which are not specifically illustrated, which include similar apparatus (combustion systems) operating in a similar fashion (burning fuels) for similar purposes (application of heat to 'work'). Such equivalents include reheat furnaces, soaking pits, melting furnaces, recovery boilers, lime kilns, enhanced oil recovery steam generators, and the like.

The application of the invention extends to multizoned reheat or other furnaces, whether designed to burn gas, oil, or waste gas. The maximization method and apparatus of the present invention can separately control the amount of combustion air as a function of the calculated absorbed net heat release to fuel demand or to fuel flow ratio. Since steam output is not the objective, but rather heating of workpieces, the heat input and output may be calculated from the 'work' temperature of the slab, the pace or speed of the furnace, and the mass flow of the slabs. The 'work' temperature of the slabs may be inferred by wall thermocouples, or directly measured, as by pyrometers. The mass flow in and out of each can be assumed to be constant, can be manually entered by the operator, or determined automatically and down-loaded to the optimizer portion of the invention from another computer or system (not part of the present invention). Additionally, since combustion gas flow and metal flow is usually counter-current and multi-zoned, heat input to each zone is the sum of any common inlets, for example, where two soak zones enter one heat zone.

In another example, the improved combustion process of the present invention may be applied as an enhanced oil recovery steam generator, usually located in the oil field. The boiler should be designed to burn either reclaimed oil or natural gas, or combinations thereof. The system may separately control the amount of combustion air as a function of the calculated absorbed net heat release to fuel demand or to fuel flow. The output of such steam generators is ordinarily steam of less than 100% quality, so the heat output can be calculated from the total mass flow of the feedwater in and a quality feedback measurement signal, or may be calculated from pressure, temperature, and ratio of desired quality.

We claim:

1. In a combustion system having a combustion chamber, controllable fuel inputs and/or air inputs, an exhaust outlet path, heat absorbing means, and means for measuring the temperature of combustion products in the exhaust outlet path, the method of controlling the air/fuel ratio input to the combustion system without measuring the oxygen or carbon monoxide in the exhaust outlet path, comprising the steps of:

(a) determining, as the absorbed net heat released, the total heat release which is absorbed by the heat absorbing means;

(b) determining the stack heat losses as measured by said means for measuring the temperature of combustion products in the exhaust outlet;

(c) determining the net heat released by the combustion process by summing the absorbed net heat release and the stack heat losses;

(d) calculating a first and at least one successive relative index value related to the absorbed net heat release from the combustion system;

(e) identifying from comparison of each successive index value with the previous index value the relative index value having the greatest magnitude; and (f) adjusting the air/fuel input ratio to the combustion system in an amount to optimize the combustion process according to the relative index value of greatest magnitude.

2. The method of claim 1 further including a first step of:

determining the net heat inputs to the combustion chamber.

3. The method of claim 1 further including the steps of:

storing the reative index value of absorbed net heat release; and repeating steps (a) through (e) and the preceding storage step to produce subsequent absorbed net heat release relative index values.

4. The method of claim 2 further including the step of:

periodically repeating steps (a) through (f).

5. The method of claim 1, further including the steps of identifying external constraints and interrupting step (f) according to said external constraints.

6. The method of claim 1, wherein an air bias is incorporated in step (f).

7. The method of claim 6, wherein the air bias increases the percent theoretical air supplied to the combustion process.

8. The method of claim 6, wherein the air bias decreases the percent theoretical air supplied to the combustion process.

9. The method of claim 1, wherein the air or fuel flow changes in step (f) are limited in size.

10. The method of claim 1 further including the steps of:

repeating steps (a) through (d);

storing the values derived from repeating steps (a) through (d); and calculating an average of the stored values before proceeding with step (e).

11. A combustion system having a combustion chamber, controllable fuel inputs and/or air inputs, an exhaust outlet path, heat absorbing means, and means for measuring the temperature of combustion products in the exhaust outlet path, apparatus for controlling the air/fuel ratio input to the combustion system without measuring the oxygen or carbon monoxide in the exhaust outlet path, comprising:

(a) means for determining, as the absorbed net heat release, the total heat release whcih is absorbed by the heat absorbing means;

(b) means for determining the stack heat losses as measured by said means for measuring the temperature of combustion products in the exhaust outlet;

(c) means for determining the net heat released by the combustion process including the absorbed net heat release and the stack heat losses as measured by said means for measuring the temperature of combustion products in the exhaust outlet;

(d) means for calculating a first, relative index value related to the absorbed net heat release from the combustion system and successive relative index values;

(e) means for identifying from comparison of each successive index value with the previous index value the relative index value having the greatest magnitude; and (f) means for adjusting the air/fuel input ratio to the combustion system in an amount to optimize the combustion process according to the relative index value of greatest magnitude.

12. The apparatus of claim 11, further including:

means for storing the relative index value of absorbed net heat release.

13. The apparatus of claim 12, further including means for averaging more than one such value.

14. The apparatus of claim 11, further including the means for detecting external constraints.

15. The apparatus of claim 14, further including means for interrupting adjustment of the fuel/air ratio according to external constraints.

16. The apparatus of claim 11, further including means for incorporating an air bias in the fuel/air ratio.

17. The apparatus of claim 16, wherein the air bias increases the percentage theoretical air supplied to the combustion process.

18. The apparatus of claim 16, wherein the air bias decreases the percent theoretical air supplied to the combustion process.

19. The apparatus of claim 11, further including means for limiting the amount of fuel changes in the air/fuel ratio.

20. The apparatus of claim 11, further including means for limiting the amount of air flow changes in the air/fuel ratio.

21. A combustion system having a combustion chamber, controllable fuel inputs and/or air inputs, an exhaust outlet path, heat absorbing means, and means for measuring the temperature of combustion products in the exhaust outlet path, apparatus for controlling the air/fuel ratio input to the combustion system without measuring the oxygen or carbon monoxide in the exhaust outlet path, comprising:

(a) means for determining the net heat inputs to the combustion chamber;

(b) means for determining, as the absorbed net heat release, the total heat release which is absorbed by the objective process;

(c) means for determining the stack heat losses as measured by said means for measuring the temperature of combustion products in the exhaust outlet;

(d) means for determining the net heat released by the combustion process by summing the net heat inputs to the combustion chamber, the absorbed net heat release, and the stack heat losses as measured by said means for measuring the temperature of combustion products in the exhaust outlet;

(e) means for calculating a first, relative index input related to the absorbed net heat release from the combustion system and successive relative index values;

(f) means for identifying from comparison of each successive index value with the previous index value the relative index value having the greatest magnitude; and (g) means for adjusting the air/fuel input ratio to the combustion system in an amount to optimize the combustion process according to the relative value of greatest magnitude.

22. The apparatus of claim 21, further including: means for storing the relative index value of absorbed net heat release.

23. The apparatus of claim 22, further including means for averaging more than one such value.

24. The apparatus of claim 21, further including the means for detecting external constraints.

25. The apparatus of claim 24, further including means for interrupting adjustment of the fuel/air ratio according to external constraints.

26. The appartus of claim 21, further including means for incorporating an air bias in the fuel/air ratio.

27. The apparatus of claim 26, wherein the air bias increases the percent theoretical air supplied to the combustion process.

28. The apparatus of claim 26, wherein the air bias decreases the percent theoretical air supplied to the combustion process.

29. The apparatus of claim 21, further including means for limiting the amount of fuel flow changes in the air/fuel ratio.

30. The apparatus of claim 21, further including means for limiting the amount of air flow changes in the air/fuel ratio.

* * * * *

UNITED STATES PATENT AND TRADEMARK OFFICE

CERTIFICATE OF CORRECTION

PATENT NO. : 4,749,122

DATED : June 7, 1988

INVENTOR(S) : Shriver et al

It is certified that error appears in the above-identified patent and that said Letters Patent is hereby corrected as shown below:

Col. 1, line 43, please change "ecess" to --excess--.

Col. 4, line 28 please change "mesures" to --measures--.

Col. 5, line 49, change "tape" to --type--.

Col. 6, lines 23 and 24, change "optimizalization" to --optimization--;

line 42, change "otther" to --other--;

line 49, delete "the".

Col. 8, line 49, change "underlined" to --italicized--;

line 68, change "cyclem" to --cycle--.

UNITED STATES PATENT AND TRADEMARK OFFICE

CERTIFICATE OF CORRECTION

PATENT NO. : 4,749,122

DATED : June 7, 1988

INVENTOR(S) : Shriver et al

It is certified that error appears in the above-identified patent and that said Letters Patent is hereby corrected as shown below:

Col. 9, line 12, change "Micro TM" to --Micro TM-- line 15, change "Spectrum TM: to --Spectrum TM--;

line 31, change "blodk" to --block--.

Col. 11, line 1, change "like" to --lime--;

lines 11 through 26, please change to read as follows:

--Divide the heat content of steam produced (in BTU/Hr.) by the lower heating value of the fuel (in BTU/lb.). Divide the result (in lb./Hr.) by the estimated percentage efficiency (decimal format). This estimated value is usually between 60 percent and 85 percent for solid fuel boilers. This percentage may also be It is certified that error appears in the above-identified patent and that said Letters Patent is hereby corrected as shown below:

estimated by measuring stack temperature, making a percent oxygen test by Orsat analyzer or portable analyzer, knowing the composition of the fuel being burned at the time of measurement. Further estimation methods are available from the ASME. The result of this calculation is a good approximation of fuel flow in lb./Hr.

Once this estimate of fuel flow is obtained, there are several methods of determining the estimated composition, weight, and heat content of the flue gases, knowing the analysis of the fuel.--

Col. 11, line 35, "weight of combustion products" should be --<u>weight of combustion products</u>--.

UNITED STATES PATENT AND TRADEMARK OFFICE

CERTIFICATE OF CORRECTION

PATENT NO. : 4,749,122

DATED : June 7, 1988

INVENTOR(S) : Shriver et al

It is certified that error appears in the above-identified patent and that said Letters Patent is hereby corrected as shown below:

Col. 12, line 50, change "Whiley" to --Wiley--.

Col. 13, lines 32 through 38, should be indented.

line 39 begins a new paragraph and should have a paragraph indentation.

Col. 16, line 28, delete the first occurrence of "or".

Col. 19, line 19, change "input" to --value--.

Signed and Sealed this

Third Day of January, 1989

*Attest:*

DONALD J. QUIGG

*Attesting Officer*

*Commissioner of Patents and Trademarks*